US005765616A

United States Patent [19]

Nishii

[11] Patent Number: 5,765,616

[45] Date of Patent: Jun. 16, 1998

[54] CUTTING APPARATUS FOR WORKING WOOD

[76] Inventor: Shigeo Nishii, 2-28, 4-chome, Kitakagaya, Suminoe-ku, Osaka-city, Osaka-prefecture, Japan

[21] Appl. No.: 785,605

[22] Filed: Jan. 17, 1997

[51] Int. Cl.[6] ..... B27C 1/10

[52] U.S. Cl. ..... 144/117.4; 30/475; 144/119.1; 144/114.1

[58] Field of Search ..... 144/114.1, 117.1, 144/117.4, 119.1; 30/475, 476, 477; 451/294, 350, 352

[56] References Cited

U.S. PATENT DOCUMENTS

| | | | |
|---|---|---|---|
| 795,997 | 8/1905 | Mathews | 144/119.1 |
| 1,060,041 | 4/1913 | Wagner | 144/119.1 |
| 4,360,048 | 11/1982 | Schadlich et al. | 30/475 |
| 4,442,878 | 4/1984 | Moriguchi et al. | 30/475 |

*Primary Examiner*—W. Donald Bray
*Attorney, Agent, or Firm*—Wenderoth, Lind & Ponack

[57] ABSTRACT

A lift case, provided for its possible height adjusting operation, on the front portion side of the apparatus main body provided with electrically driven rotating cutting tools, a plurality of profiling plates provided for their possible lift respectively on the rear portion side from the lift case and the apparatus main body, a profiling plate securing means for fixing the plurality of profiling plates, an urging means for urging the lower edge portions of the profiling plates onto the cutting face of the cut wood under the releasing of the fixing. Release the fixing of the profiling plates to raise the cutting apparatus for working the wood, and a plurality of profiling plates are urged, projected from the lift case and the rear portion side of the apparatus main body. Press the lower edge portions of the profiling plates against the cutting face of the wood as a cutting object in this condition, and the lower edge portions of the plurality of profiling plates is changed in posture so that the lower edge portions of the plurality of profiling plates may be profiled along the cutting face of the cut wood T against the urging force of the urging means even if the cutting face is the convexly curved face, the concavely curved face without limitation that the cutting face is the flat face.

Fix a plurality of profiling plates profiled onto the cutting face by a profiling plate securing means, and the imaginary base face along the cutting face of the cut wood is formed before and after the rotary cutting tools by the lower edge portions of the plurality of profiling plates. Then, adjust the height of the lift case adjusting to the cut rate. The cutting face is finished mechanically by the electrically driven rotary cutting tools even if the cutting face of the cut wood is the flat face, the convexly curved face or the concavely curved face by sliding operation, in the front, rear direction, of the wood work cutting apparatus, namely, sliding operation in the front, rear direction by causing the rotary cutting tools along the cutting face.

11 Claims, 8 Drawing Sheets

CUTTING APPARATUS FOR WORKING WOOD

BACKGROUND OF THE INVENTION

1. Field of the Invention

The present invention relates generally to a cutting apparatus for working wood, provided with electrically driven rotary cutting tools to be used while sliding in a longitudinal direction with the tools being profiled along the cutting face of the cut wood.

2. Description of the Prior Art

A cutting apparatus for working the wood of a planer specification is adapted to smoothly finish the cut wood with rotary cutting tools having, for example, planer edges provided on an apparatus main body in a condition where their cutting portions being slightly projected downwards, as the above described cutting apparatus for working the wood.

Concretely, the cutting apparatus for working the wood of the planer specification is provided with rotary cutting tools provided with two planer edges in a rotary rotor being provided for possible driving, rotating operations around a horizontal shaft in right, left directions with respect to the apparatus main body in a condition where its cutting portion is slightly projected downwards, a lift member for its possible adjusting operation on the front portion side from the rotary cutting tools of the apparatus main body, and the lower face portion of the lift member and the lower face portion on the rear portion side from the rotary cutting tools of the apparatus main body being formed respectively on flat base faces. The cutting apparatus for working the wood is slid in its longitudinal direction with the front, back base faces of these apparatuses being profiled onto the cutting face of the cut wood after the height of the base face of the lift member has been adjusted to the cut rate, namely, is slid with the rotary cutting tools being slid, profiling onto the cutting face, so that the cut wood is adapted to be finished smoothly.

The cutting apparatus for working the wood of the above described construction was limited to the flat face in the cutting face of the cut wood, because the flat base face was provided on the front and back of the rotary cutting tools. Skilled persons who were familiar with a way of using the cutting apparatus for working the wood sometimes could not cut the cutting face, because the flat base face interfered when the cutting face of the cut wood was convexly curved face or concavely curved face. The skilled persons finished manually, with special planers, in an old-time method.

In addition to the above described apparatus, a circular wire brush specification planted with short wires on rotary rotors, or a sand belt specification with endless sand belt being entrained around a pair of rotary rotors was used as rotary cutting tools.

The rotary cutting tools of the above described wire brush specification was used in the workmanship of raising the grains of the cut wood, cutting the wood portion among the soft annual rings of the cut wood. The rotary cutting tools of the sand belt specification took much more time to plane the cut wood and was used in rough machining before the plane finishing when the cut rate was shallow in the saw finishing. These wood working cutting apparatuses were limited to the flat face as the cutting object of the cut wood. When the cutting object was convexly curved face or the concavely curved face, the finishing depended upon the manual operations.

SUMMARY OF THE INVENTION

Accordingly, an object of the present invention is to provide a cutting apparatus for working the wood capable of having convexly curved face or concavely curved face, needless to flat face, as cutting objects.

The cutting apparatus for working the wood of the invention which has achieved the above described objects comprises electrically driven rotary cutting tools to be driven, rotated around the horizontal shaft in right, left directions, provided on the apparatus main body with its cutting working portion is slightly projected downwards, with the rotary cutting tools being used slidingly along the longitudinal direction, profiling onto the cutting face of the cut wood, a lift case provided for its possible height adjusting operation on the front portion side from the rotating cutting tool of the apparatus main body, a plurality of profiling plates provided for their possible lift respectively in the longitudinal direction on the rear portion side from the lift case and the rotary cutting tools of the apparatus main body, a profiling plate securing means for fixing the plurality of profiling plates, an urging means for urging the lower edge portions of the profiling plates into contact with the cutting face of the cut wood under the- releasing of the fixing.

According to the above described construction, raise the cutting apparatus for working the wood to release the fixing of the profiling plates by the profiling plate securing means or release the fixing of the profiling plates by the profiling plates securing means to raise the cutting apparatus for working the wood, and a plurality of profiling plates are urged, projected from the lift case and the rear portion side of the apparatus main body.

Press the lower edge portions of the profiling plates against the cutting face of the wood as an cutting object in this condition, and the lower edge portions of the plurality of profiling plates are changed in posture so that the lower edge portions of the plurality of profiling plates may be profiled along the cutting face of the wood cut against the urging force of the urging means if the cutting face is convexly curved face or concavely curved face without limitation that the cutting face is the flat face, although it depends upon the curvature radius of the cutting face and the lift rate of the profiling plate.

Fix a plurality of profiling plates profiled onto the cutting face by a profiling plate securing means, and the imaginary base face along the cutting face of the cut wood is formed before and after the rotary cutting tools by the lower edge portions of the plurality of profiling plates. Then, adjust the height of the lift case adjusting to the cut rate. The cutting face can be planed off mechanically with the electrically driven rotary cutting tools even if the cutting face of the cut wood is the flat face, the convexly curved face or concavely curved face by sliding operation, in the longitudinal direction, of the wood work cutting apparatus, namely, by sliding operation in the longitudinal direction with the rotary cutting tools being profiled along the cutting face.

DESCRIPTION OF THE PREFERRED EMBODIMENTS

Figure 1:
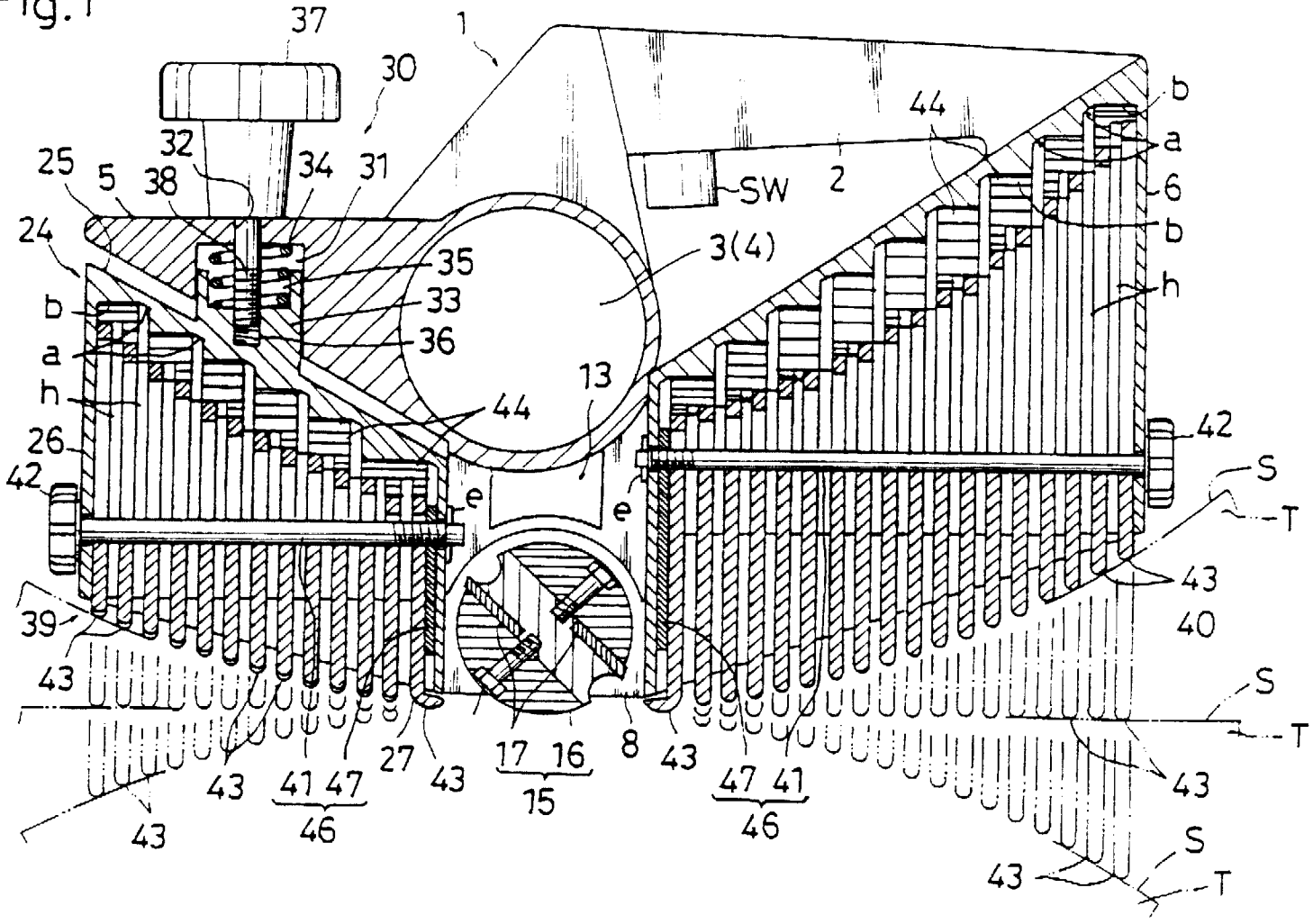
FIG. 1 shows an embodiment of a cutting apparatus for working the wood of the invention of the present application and is a longitudinal side face view of the whole apparatus.

The embodiments of the invention will be described hereinafter with reference to the drawings. FIG. 1 through FIG. 6 show cutting apparatuses for wood working use of a planer specification in one embodiment of the invention. Referring now to FIG. 1 through FIG. 4, reference numeral 1 is an apparatus main body made of synthetic resin provided with a grip handle 2 for sliding operation, with an accommodating portion 4 of an electric motor 3 to be driven, rotated around a quadrature axis, a projecting portion 5 forwards of the accommodating portion 4, a case 6 on the rear portion side whose bottom is opened, wall plates 7, 8 onto both the right, left sides of the motor accommodating portion 4 being formed.

The bottom face of the projecting portion 5 among them is formed on the slant face inclined to the front rising from the lower portion side of the motor accommodating portion 4.

The opening lower edge portion around the rear portion side case 6 is formed to be inclined to the rear rising from the rear end portions of the right, left wall plates 7, 8 and the ceiling face of the case 6 has a step portion b, connected with the slant portion a, onto one end side formed to the rear rising shape.

Reference numeral 9 is a side portion cover for covering a dust discharging fan 11 connected to the motor shaft 10, and a right wall plate 8. The motor shaft 10 of the motor 3 is housed on the bearings 12, 12 provided on the cover 9 and the outer side of the motor accommodating portion 4.

And exhaust ports 13, 14 are formed respectively on the wall plate 8 covered by the cover 9 and on the face portion confronted on the dust discharging fan 11 of the cover rear face portion.

Reference numeral 15 is a rotary cutting tool composed of two exhaust openings 13, 14 being clamped with bolt c to the rotary rotor 16. The horizontal shaft 18 of the rotary rotor 16 is housed on bearings 19, 19 provided on the side portion cover 9 and the wall plate 8 with the cutting portions of the planer cutting edges 17 being slightly projected downwards of the wall plates 7, 8.

Reference numeral 20 is an endless transmission belt driven, rotated by the motor 3, which is entrained on pulleys 21, 22 attached to the motor shaft 10 and the rotary horizontal shaft 18. Reference numeral 23 is a transmission belt cover.

According to the construction described above, the rotary cutting tools 15 are driven, rotated, together with the dust discharging fan 11 by the actuation of a switch SW.

And slide the wood work cutting apparatus forwards with the rotary cutting tools 15 provided along the cutting face of the cut wood T, and the cutting face of the cut wood T is cut up by a pair of rotating planer cutting edges 17. The planer cut shavings are discharged rearwards of the side portion of the apparatus main body 1 from the exhaust portion 14 of the side portion cover 9 with air currents caused by the rotation of the dust discharging fan 11 through the discharging opening 13 of the wall plate 7.

Referring now to FIG. 1 through FIG. ?, reference numeral 24 is a lift case provided on the lower portion side of the projecting portion 5 of the apparatus main body 1, which is composed of a ceiling plate 25 to be inclined opposite to the lower face of the projecting portion 5 of the apparatus main body 1, and front, rear and right, left side plates 26 through 29 hung to the peripheral edge portion thereof. The lower edge portions around the opening by the side plates 26 through 29 are formed to be inclined to the front rising from the front end portions of the right, left wall plates 7, 8.

Also, a step portion b which rises forwards opposite to the step portion b formed on the ceiling face of the rear portion side case 6 is formed, with the slant portion a, on the ceiling face of the lift case 24.

Reference numeral 30 is a means for adjusting the height with respect to the lift case 24, constructed as follows. Namely, as described in FIG. 1, a circular concave potion 31 to open downwards, and a through hole 32 to open in the ceiling ace of the concave portion 31 are formed in a concentric shape around vertical axis to each other on the projecting portion 5. A circular member 33 to be engaged closely into the circular concave portion 31 is provided on the slant overhead plate of the lift case 24. The receiving concave portion 35 of the spring 34 and a tapped hole 36 to open in the bottom face of the concave portion 35 are formed in a concentric shape to each other. Further, a screw member 38 inserted into grip hand 37 is screwed into a tapped hole 36 through the through hole 32.

In the above described construction, the lift case 24 is raised against the urging force of the spring 34 by the clamping operation of the screw member 38 with the grip handle 37. The lift case 24 is pulled down by the urging force of the spring 34 by the loosing operation of the screw member 38 with the grip handle 37. The lift case 24 is adjusted slightly without rotation with the rear side plate 27 of the lift case 24 being in contact with the front edge portion of the wall plates 7, 8.

Reference numerals 39, 40 are apparatuses for causing the rotary cutting tool 3 to slide along the cutting face S of the cut wood T in the sliding operation in the front, rear directions of the wood work cutting apparatuses.

Figure 2:
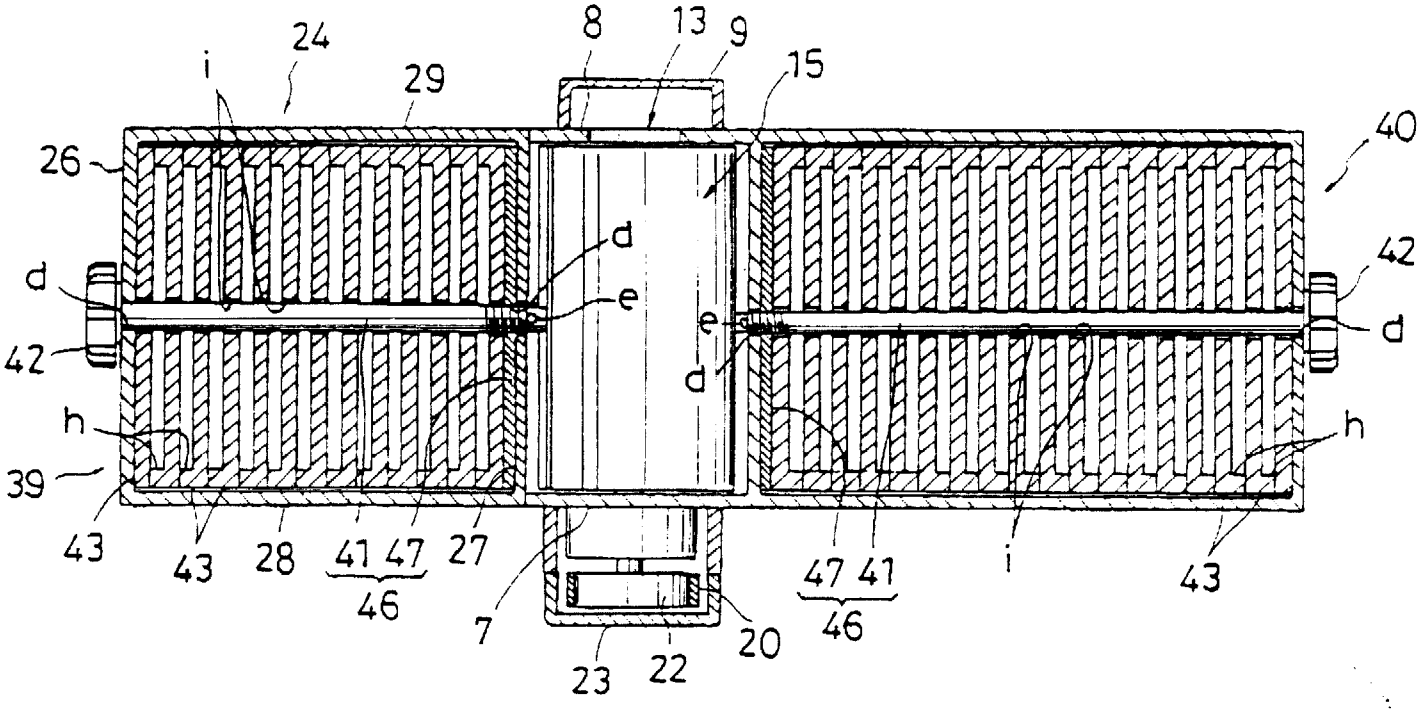
FIG. 2 shows the embodiment of the cutting apparatus for working the wood thereof, and is a cross-sectional view of the entire apparatus cut along the screw shaft portion of the profiling securing means.
Figure 3:
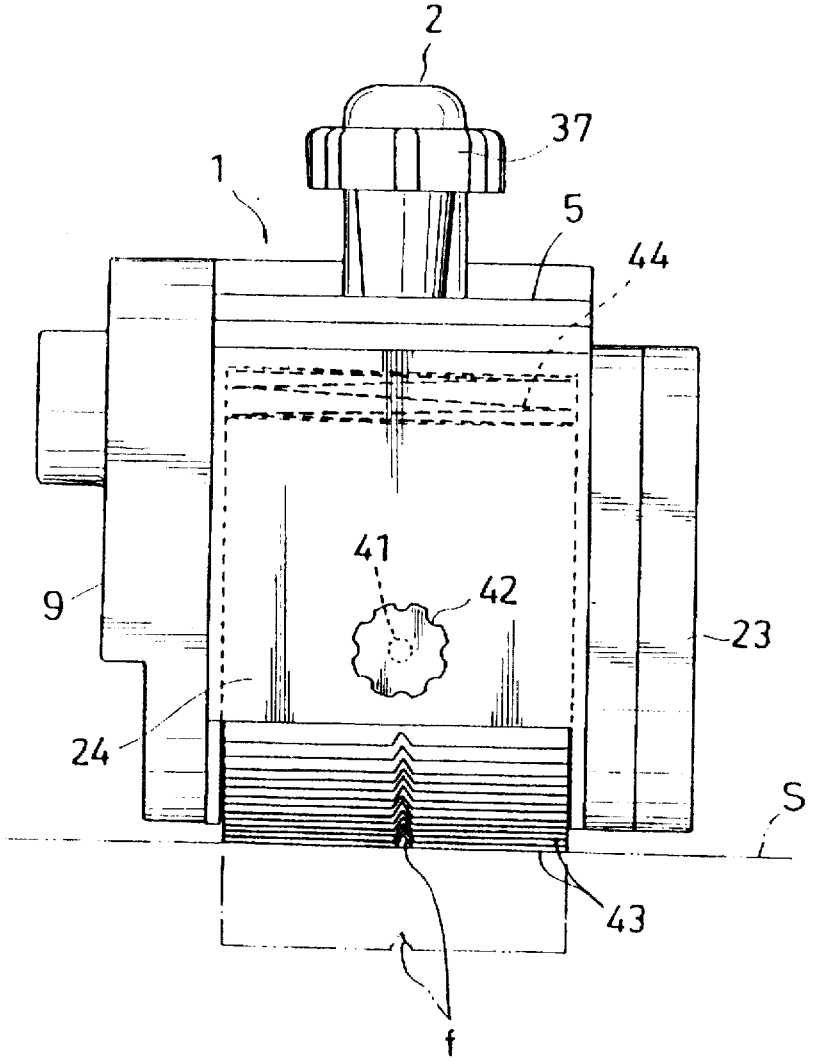
FIG. 3 shows the embodiment of the cutting apparatus for working the wood thereof, and is a front face view of the apparatus.
Figure 4:
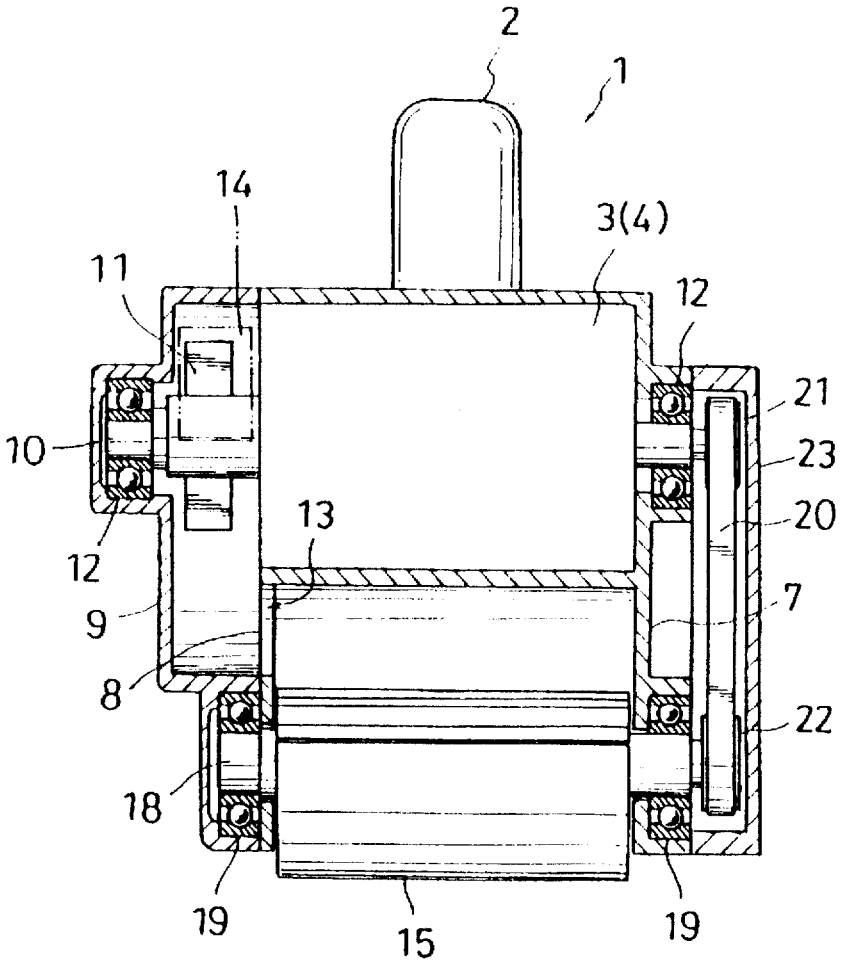
FIG. 4 shows the embodiment of the cutting apparatus for working the wood thereof, and is a sectional view taken along a line X—X of FIG. 1.

The profiling apparatus 39 on the front portion side will be described hereinafter with reference to FIG. 5, because these profiling apparatuses 39, 40 are same in construction although the profiling apparatus 40 on the rear portion side is provided on the rear portion side case 6 of the apparatus main body 1 symmetrically with the profiling apparatus 39 on the front portion side with scale being different to each other being provided in the lift case 24 as shown FIG. 1, FIG. 2.

The profiling apparatus 40 to be provided on the rear portion side case 6 is designated with the same reference numerals as those in the construction member of the profiling apparatus 39.

As shown in FIG. 1 through FIG. 3 and FIG. 5, reference numeral 41 in the drawings is a screw shaft provided with a grip handle 42 which is inserted, retained for its possible rotation across the concentric shaped through holes d, d (FIG. 2) formed in the front, rear side plates 26, 27 of the lift case 24 with a slip-out preventing pin e being provided in the insertion end portion.

Reference numeral 43 is a plurality of profiling plates to be accommodated in the lift case 24 whose lower edge portions are directed in the right, left directions, being made of synthetic resin or metal of aluminum or the like. These profiling plates 43 are set shorter in vertical size as the profiling plates are closer to the rotary cutting tool 15. The profiling plate 43 positioned on the front and the rear by the side of the rotary cutting tool 15 are curved towards the rotary cutting tool 15. The lower edge portion of the profiling plate 43 except it is worked into the convexly curved face within the range of the thickness.

A V-cut f for assisting the straight line sliding of the wood work cutting apparatus is formed in the center of the width direction of the lower edge portion of the profiling plate 43. Spacers h, h are provided, on both the right, each of the sides thereof, on the profiling plate 43 except the outermost side (case front end side). The long hole i in the vertical direction which allows the screw shaft 41 to insert through is formed in the central portion of the width direction in each of the profiling plates 43. Each of the profiling plates 43 can move loosely vertically within the range where the vertical end portion of the long hole i is in contact with the screw shaft 41.

The long hole i is set short in long hole size considering the vertical size of the profiling plate 43. The long hole middle point in the vertical direction is formed so as to approximately agree with the axial line of the screw shaft 41 with the lower edge portions of the plurality of profiling plates 43 being in contact with the horizontal face.

The V-cut f is not formed in the lower edge portion of the profiling plate 43 in the profiling apparatus 40 of the rear portion side case 6, because the V-cut f assists with a guide the straight line sliding of the wood work cutting apparatus.

Reference numeral 44 is an urging means for elastically moving the profiling plate 43 across the full range of the long hole i, which urges the lower edge portion of the profiling plate 43 to profile into contact with the cutting face S of the cut wood T. The lower edge portions of the profiling plates 43 are adapted to profile along the cutting face S separately by one urging means 44 with three plates as one set in three profiling plates 43 positioned near of the rotary cutting tool 15 and two as one set in the profiling plates 43 except it.

Figure 5:
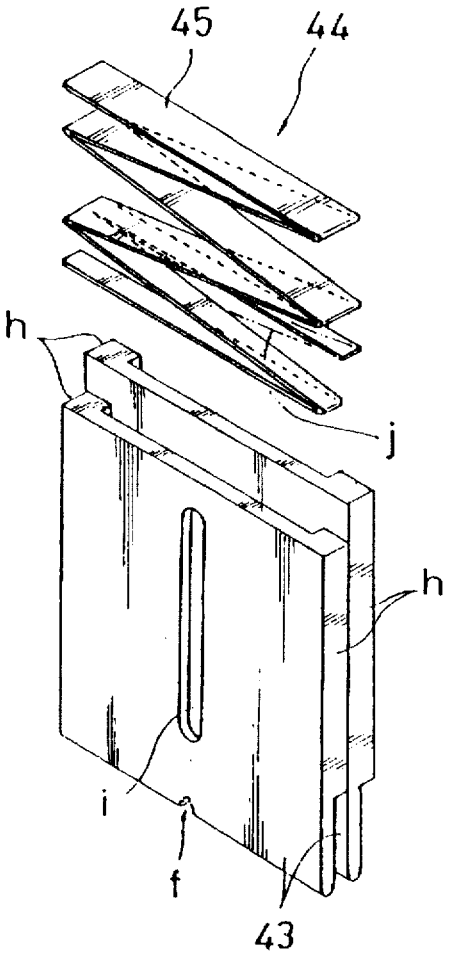
FIG. 5 shows the embodiment of the cutting apparatus for working the wood thereof, and is a perspective view of an urging means with respect to two profiling plates as one set.
Figure 6:
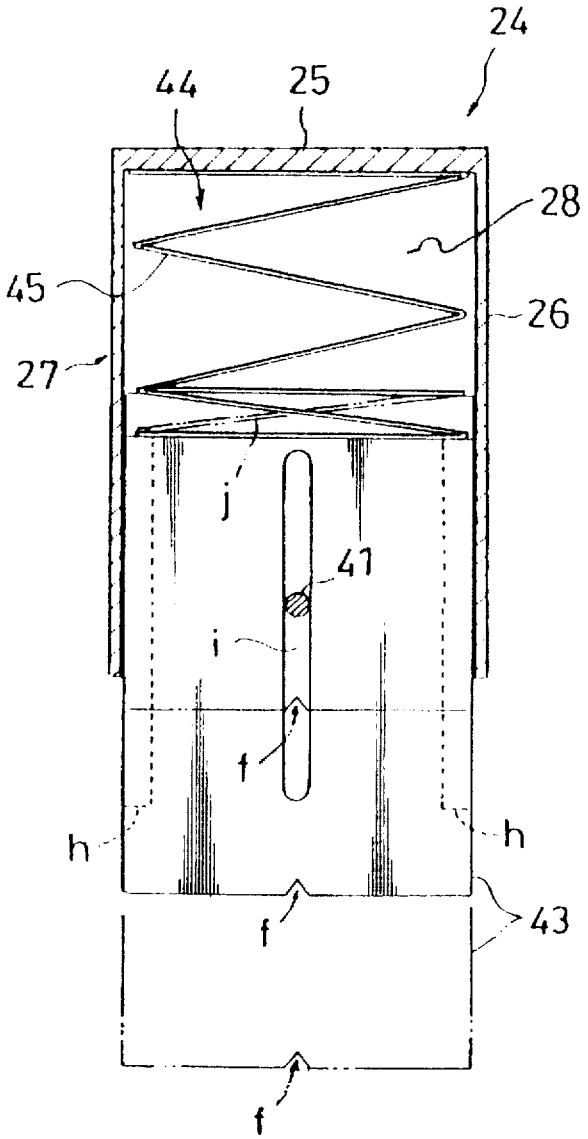
FIG. 6 shows the embodiment of the cutting apparatus for working the wood thereof, and is a sectional view showing a condition where the profiling plates are urged against the vertical middle by the urging means.

FIG. 5 and FIG. 6 show an urging means 44 with two profiling plates 43, 43 positioned on both the sides with the spacer h being grasped as an urging object.

The urging means 44 is turned up zigzag within right, left width of the lift case 24 with the spring steel across the full width of two profiling plates 43, 43 as a material 45. The lower end side (shown with imaginary line j) of the two divided plate portion on the side corresponding to the long profiling plate 43 of them is removed with the two turned-up plate portions on the turn up lower end side being divided in the middle portion of the width direction. The construction can be adopted which cuts the spring steel of the material 45 into a predetermined shape to turn up it zigzag.

The urging means 44 with three profiling plates 43, . . . as an object is formed same in construction with the spring steel across the full width of three profiling plates 43, . . . adjacent with a spacer h being grasped. The width of the step portion b on the ceiling face of the lift case 24 is set to adjust these material widths.

In the profiling apparatus 40 on the rear portion side, spacers h, h are provided on both the right, left sides of the profiling plate 43 except the outermost side (case rear end side). These lower edge portions are adapted to be profiled to the cutting face S separately by the one urging means 44 with two profiling plates 43 as one set.

Reference numeral 46 is a profiling plate fixing means which is composed of a screw shaft 41 provided with the grip handle 42, a profiling plate pressing member 47, positioned between the rear side plate 27 of the lift case 24 and the profiling plate 43, for screwing the front end side of the screw shaft 41 as shown in FIG. 1 through FIG. 3 and FIG. 5, FIG. 6. The profiling plate pressing member 47 is pulled towards the side of the front side plate 26 of the lift case 24 through clamping of the screw shaft 41 by the grip handle 42. A plurality of profiling plates 43, . . . are constructed to be secured at one effort by pressure of the plurality of profiling plate 43 by the profiling pressure member 47 and the front side plate 26.

The profiling apparatus 39 of the above described construction is built in in the following manner although the same things can be said about the profiling apparatus 40 to be built on the rear portion side case 6 of the apparatus man body 1.

Namely, the urging means 44 is dropped into the step portion b of the case ceiling face through the opening by the surrounding side plates 26 through 29 with the lift case 24 being faced upwards.

The urging means 44 is guided to the slant portion a and is settled in the step portion b as expected if the urging means 44 is dropped easily, because the slant portion a is formed connecting with the step portion b while adjusting the width of the step portion b to the material width of the urging means 44.

The profiling plate pressing member 47 is inserted between the rear side plate 27 of the lift case 24 and the profiling plate 43, while the profiling plate 43 formed respectively to the given length being placed on the urging means 44. And the screw shaft 41 is inserted across the through hole d of the front side plate 26 and the long holes i of the plurality of profiling plates 43. It is inserted into the through hole of the rear side plate 27, while screwing into the tapped hole of the profiling plate pressing member 47. The coming off preventing pin e is provided in the front end portion of the screw shaft 41. Therefore, the assembling operation of the profiling apparatus 39 with respect to the lift case 24 is completed.

According to the wood work cutting apparatus of the invention constructed described above, release the fixture of the profiling plate 43 by the profiling plate securing means 46 by raising the wood work cutting apparatus or lift the wood work cutting apparatus by releasing the fixture of the profile plate 43 by the profiling plate securing means 46, and the lower edge portions of the plurality of profiling plates 43, . . . are urged downwards from each of the rear portion side case 6 and the lift case 24.

Press the lower edge portion of the profiling plate 43 on the cutting face S of the wood T as the cutting object in this condition and the lower edge portions of the plurality of profiling plates 43 is changed in posture so that the lower edge portions of the plurality of profiling plates 43 may be profiled along the cutting face S of the cut wood T against the urging force of the urging means 44 if the cutting face S is the convexly curved face or the concavely curved face without limitation that the cutting face S is the flat face, as shown in FIG. 1, although it depends upon the curvature radius of the cutting face S and the lift rate of the profiling plate 43.

In FIG. 1, the cutting face S of the cut wood T shows with the actual line, the profiling posture of the profiling plate 43 which is the concavely curved of 300 mm in, for example, curvature radius. The lower edge portions of the plurality of profiling plates 43 can be profiled onto the optional cutting face S when they are within the range of the curvature radius, although the profiling postures of the profiling plates 43 are shown in the respective imaginary lines when the cutting face S of the cut wood T is an endless flat face of the curvature radium, and the cutting face S of the cut wood T is the convexly curved face of 300 mm in curvature radius.

The setting of the above described curvature radius is simply one example, is optional within the specific range although the lift rate of the profiling plate 43 and the front, rear length of the wood work cutting apparatus is limited.

Fix a plurality of profiling plates 43 profiled onto the cutting face S of the out wood T by a profiling plate securing means 46, and the imaginary base face along the cutting face S of the cut wood T is formed before and after the rotary cutting tool 15 by the lower edge portions of the plurality of profiling plate 43. Then, adjust the height of the lift case 24 adjusting to the cut rate. It can be planed off mechanically by the plane edges 17, 17 of the rotary cutting tool 15 even if the cutting face S of the cut wood T is the flat face, the convexly curved face or the concavely curved face by the sliding operation, in the front, rear direction, of the wood work cutting apparatus with the lower edge portion of the profiling plate 43 being provided along the cutting face S of the cut wood T, namely, the sliding operation in the front, rear direction by causing the rotary cutting tools 15 along the cutting face S.

Figure 7:
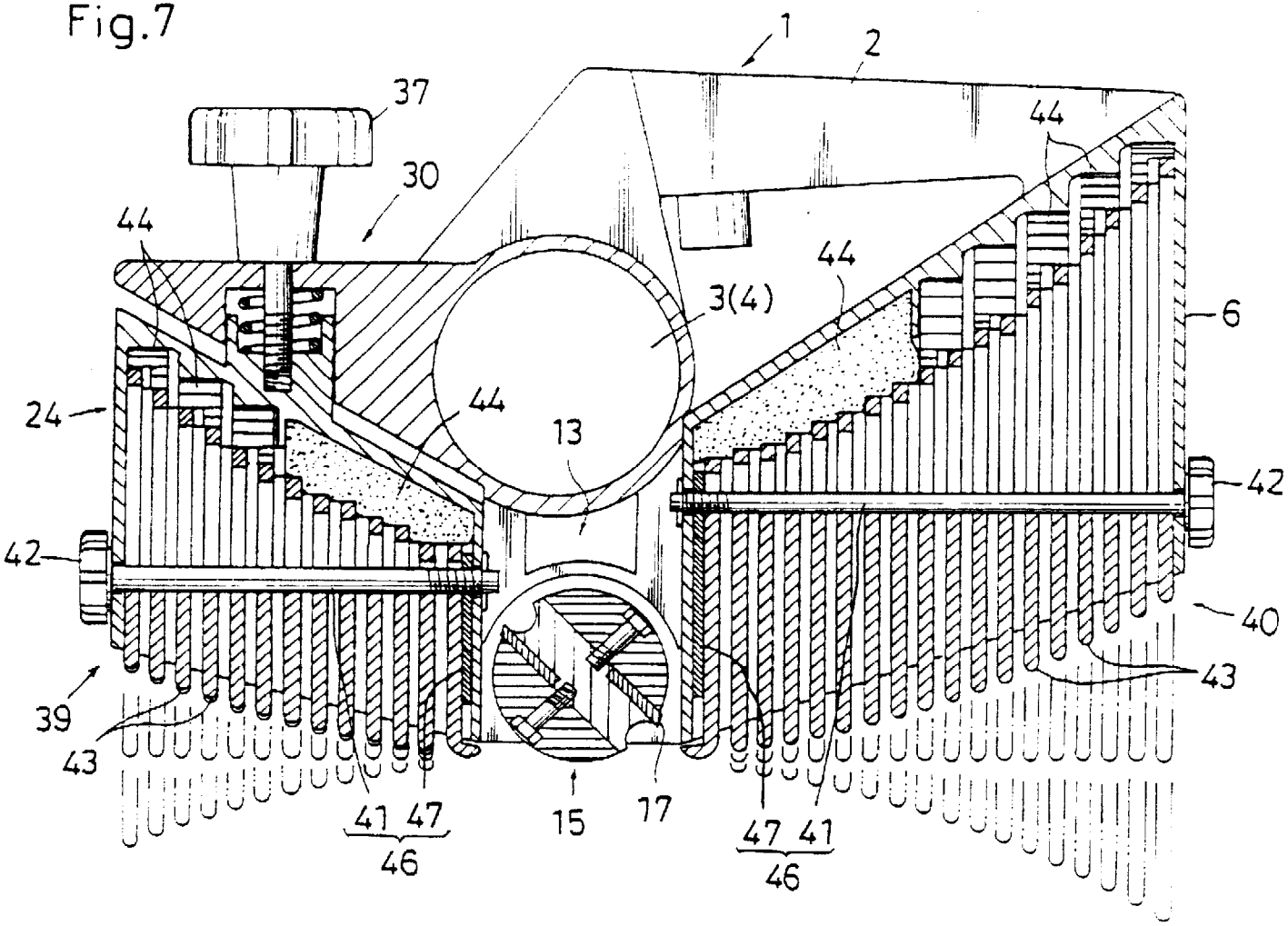
FIG. 7 shows another embodiment of the cutting apparatus for working the wood thereof, and is an entire longitudinal side face view showing the construction of the urging form made different.

In the above described embodiment, one urging means 44 may be urged about one profiling plate 43 or these lower edge portions may be profiled respectively along the cutting face S with vesicatory resin with the plurality of profiling plates 43 small in the vertical moving amount as object as shown in FIG. 7 although these lower edge portions are profiled along the cutting face S respectively by one urging means 44 with two or three profiling plates 43 as one set.

These lower portions may be profiled along the cutting face S respectively by the vescatory resin with all the profiling plates as objects.

Figure 8:
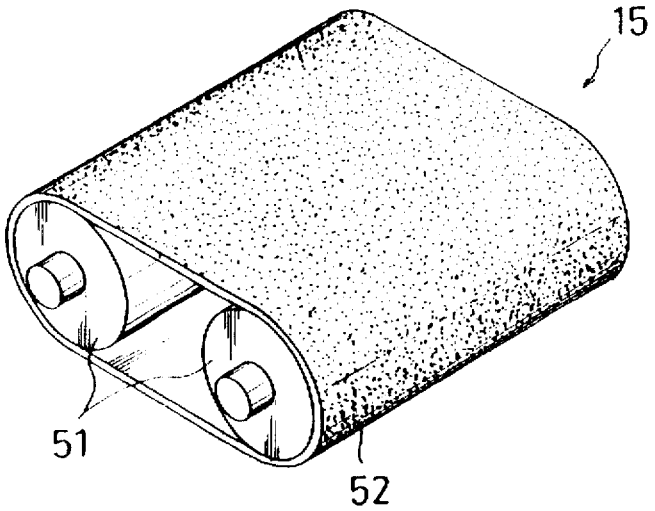
FIG. 8 shows still another embodiment of the cutting apparatus for working the wood thereof, and is an entire perspective view of rotary cutting tools constructed into a sand belt specification.

Also, the above described embodiment can provide a wood work cutting apparatus of sand belt specification, where endless sand belt 52 is entrained on one pair of rotary rotors 51, 51 as a rotary cutting tool 15, and a pair of rotary rotors 51, 51 are provided in parallel in the front, rear directions of the apparatus main body as shown in FIG. 8, in a condition the cutting portion of the sand belt 52 is slightly projected downwards, although the wood work cutting apparatus provided with rotary cutting tool 15 of planer specification is exemplified.

Figure 9:
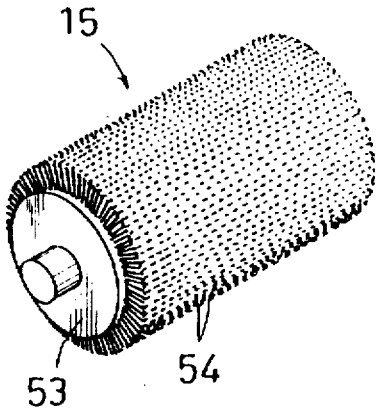
FIG. 9 shows a further embodiment of the cutting apparatus for working the wood thereof, and is an entire perspective view of cutting tools constructed into a wire brush specification.

Or as shown in FIG. 9, a wood work cutting apparatus of wire brush specification can be provided where circular wire brush construction with short wire 54 being planted on the rotary rotors 53 as the rotary cutting tool 15, a rotary rotor 53 is provided on the apparatus main body in a condition where the cutting portion of the wire 54 is projected slightly downwards.

As described above, according the wood work cutting apparatus of the invention, the flat face, and the imaginary base faces of the concavely curved face, convexly curved face are formed along the cutting face before and after the rotary cutting tools with a plurality of profiling plates being provided on the front and the rear of the rotary cutting tools and means for securing with the lower edge portions of the profiling plates being profiling along the cutting face of the cut wood. The cutting face can be mechanically planed off with good efficiency by the electric type of rotary cutting tools even if the cutting face of the cut wood is the flat face, the conventional concavely curved face or the conventional convexly curved face finished manually.

Especially skills are required for cutting operation of the concavely curved face and the convexly curved face because of no mechanical cutting means used. The ordinary persons can also handle the apparatuses although the operation can be done only with specialists. The value in the industry use is bigger, because the demands for wood working of the curved face can be increased due to the improvements in advanced art demanded.

What is claimed is:

1. A cutting apparatus for working wood, the cutting apparatus comprising:

a main body having a forward portion and a rear portion defining a rear case having an open bottom side;

a rotary cutting tool supported on a first horizontal shaft rotatably mounted on said main body, said rotary cutting tool having cutting portions which project below a lower surface of said main body so that said cutting portions can engage a work surface upon sliding motion of said cutting apparatus on a work surface;

a lift case adjustably supported on a forward portion of said main body, said lift case having an upper ceiling plate;

a plurality of profiling plates supported in said lift case, each of said profiling plates being vertically movable relative to said lift case;

securing means for fixing said plurality of profiling plates in a profiled position; and biasing means for biasing each of said profiling plates away from said ceiling plate in a downward direction, wherein said profiling plates move downwardly relative to said lift case upon release of said securing means.

2. The cutting apparatus as claimed in claim 3, further comprising:

a plurality of profiling plates supported in said rear case of said main body, each of said profiling plates being vertically movable relative to said rear case; and securing means for fixing said plurality of profiling plates, supported in said rear case, in a profiled position, wherein a work surface can be profiled both forwardly and rearwardly of said cutting tool.

3. The cutting apparatus as claimed in claim 1, wherein:

said ceiling plate is inclined in a forward direction and includes a plurality of steps formed in a lower surface of said ceiling plate; and said biasing means comprises a plurality of spring steel strips, each of said strips being disposed between one of said steps and upper edges of at least two of said profiling plates.

4. The cutting apparatus as claimed in claim 3, wherein:

said forward portion of said main body has a recess formed in a lower surface of said forward portion; and said ceiling plate comprises an upwardly extending projection which is slidably received in said recess.

5. The cutting apparatus as claimed in claim 1, wherein said lift case further comprises:

a rear side wall having first and second vertical edges;

a front side wall having first and second vertical edges;

a first lateral side wall interconnecting said first vertical edges of said rear and front side walls; and a second lateral side wall interconnecting said second vertical edges of said rear and front side walls, wherein said front, rear, and lateral sidewalls extend downwardly from peripheral edge portions of said upper ceiling plate so as to define an open bottom side.

6. The cutting apparatus as claimed in claim 5, wherein each of said profiling plates includes a vertically elongated through hole.

7. The cutting apparatus as claimed in claim 6, wherein said securing means comprises:

a screw shaft extending through a hole in said front side wall of said lift case and said elongated through holes of said profiling plates, said screw shaft having a threaded end portion and a knob for rotating said screw shaft; and a pressing plate interposed between an innermost one of said pressing plates and an interior surface of said rear side wall of said lift case, said pressing plate having a threaded through hole into which said threaded end portion of said screw shaft is received such that rotation of said screw shaft in one direction will clamp said pressing plates between said pressing member and said front side wall.

8. The cutting apparatus as claimed in claim 1, further comprising an electric motor mounted in said main body and being drivingly connected to said first horizontal shaft.

9. The cutting apparatus as claimed in claim 8, wherein said rotary cutting tool comprises a rotor and a pair of planar cutting blades mounted on said rotor so as to be rotatable about said horizontal shaft.

10. The cutting apparatus as claimed in claim 8, further comprising a second horizontal shaft rotatably mounted on said main body in parallel to said first horizontal shaft, wherein said rotary cutting tool comprises an endless sanding belt supported on said first and second horizontal shafts.

11. The cutting apparatus as claimed in claim 8, wherein said rotary cutting tool comprises an electrically driven wire brush.

* * * * *